US011343628B2

(12) United States Patent
Fuglsang-Philip et al.

(10) Patent No.: US 11,343,628 B2
(45) Date of Patent: May 24, 2022

(54) HYDROPHOBIC STRUCTURE FOR HEARING DEVICE

(71) Applicant: Oticon A/S, Smørum (DK)

(72) Inventors: Morten Fuglsang-Philip, Smørum (DK); Kenneth Rueskov Møller, Smørum (DK); Mathias Rask Møller, Smørum (DK)

(73) Assignee: Oticon A/S, Smørum (DK)

( * ) Notice: Subject to any disclaimer, the term of this patent is extended or adjusted under 35 U.S.C. 154(b) by 62 days.

(21) Appl. No.: 16/822,536

(22) Filed: Mar. 18, 2020

(65) Prior Publication Data

US 2020/0304928 A1 Sep. 24, 2020

(30) Foreign Application Priority Data

Mar. 18, 2019 (EP) ..... 19163450

(51) Int. Cl.
*H04R 25/00* (2006.01)

(52) U.S. Cl.
CPC ..... *H04R 25/65* (2013.01)

(58) Field of Classification Search
CPC .... H04R 1/1016; H04R 1/1058; H04R 1/023; H04R 25/654; H04R 2460/17; H04R 1/1075; H04R 2201/003; H04R 25/608; H04R 25/65; H04R 2225/025; H04R 2460/09; H04R 25/60; H04R 2225/021
See application file for complete search history.

(56) References Cited

U.S. PATENT DOCUMENTS

2006/0050914 A1* 3/2006 Urso ..... H04R 25/656 381/328

FOREIGN PATENT DOCUMENTS

| | | | | |
|---|---|---|---|---|
| WO | WO 2008/025355 | * | 3/2008 | ..... H04R 25/00 |
| WO | WO 2008/025355 A1 | | 3/2008 | |
| WO | WO2008025355 | * | 3/2008 | ..... H04P 25/00 |
| WO | WO 2008/080397 A1 | | 7/2008 | |
| WO | WO 2010/017816 A1 | | 2/2010 | |
| WO | WO 2010017816 | * | 2/2010 | ..... H04R 25/00 |
| WO | WO 2015/074693 A1 | | 5/2015 | |

* cited by examiner

*Primary Examiner* — Amir H Etesam

(74) *Attorney, Agent, or Firm* — Birch, Stewart, Kolasch & Birch, LLP

(57) ABSTRACT

A hearing device is provided. The hearing device is suitable for being at least partially inserted into an ear canal is provided. The hearing device comprises a barrier. The barrier is configured to prevent foreign matter inside the ear canal from passing. The barrier comprises a body and a structure. The body has a surface. The structure is a micro-structure or a nanostructure. The structure is formed on at least a first part of the surface. The first part is thus configured to hinder the foreign matter from adhering thereto. The structure and the body are monolithic.

22 Claims, 5 Drawing Sheets

HYDROPHOBIC STRUCTURE FOR HEARING DEVICE

FIELD

The present disclosure relates to a hearing device and a method for manufacturing the hearing device. More particularly, the disclosure relates to hearing device suitable for being at least partially inserted into an ear canal and to a method for manufacturing a hearing device, which is suitable for being at least partially inserted into an ear canal.

BACKGROUND

Domes are pre-sized, disposable earpieces placed on the hearing device's speaker (loudspeaker, receiver) or tube to fit comfortably in the ear canal. Domes range from open domes to closed domes (more or less ventilation). Domes are made of a soft elastomer, usually silicone, and/or foam material (hardness shore A≤85). Some domes have openings for ventilation. Domes have openings for guiding sound from the speaker to the ear or a soft membrane for transferring sound from the receiver, through the dome into the ear canal.

Ingress of earwax/cerumen, water and/or sweat (debris) into the speaker or sound tube will change the performance of the hearing device. Water, sweat or earwax (debris) could change the acoustical performance if it gets into the sound canals of the dome or increases the mass of the membrane provided at the dome.

Filters are used in hearing devices to minimize the risk of getting debris into microphones or speakers (transducers). Filters of some designs are exchangeable. Filters stop ingress of debris but are open for sound getting to microphones or coming from speakers. Filters can have small holes which let sound pass through but stop debris. Other filters have a membrane which transfers sound pressure from one side of the membrane to the other but stops debris.

The acoustical performance of the hearing device changes if the small holes in the filter are blocked/clogged or the membrane changes mass due to ingress of debris.

To deal with the adhering/sticking debris, conventionally, exchangeable domes or filters are employed. One obvious drawback is the need for regularly exchanging the domes or filters.

Another drawback is that disposable elements cause a lot of waste. Still another drawback can be the costs for regularly changing the disposable elements.

To prevent debris from adhering/sticking at domes or filters, it is known in the art to use hydrophobic coatings made from, for example, a plasmaprocessing. The hydrophobic surfaces repel debris.

Hydrophobic coatings have the drawback that the chemical coating clogs the openings in the domes and the filters, and thus prevents sound from travelling through these holes. Further, the production of coatings can often be expensive and time consuming.

Therefore, there is a need to provide a solution that addresses at least some of the above-mentioned problems.

SUMMARY

According to an aspect, a hearing device suitable for being at least partially inserted into an ear canal is provided. The hearing device comprises a barrier. The barrier is configured to prevent foreign matter inside the ear canal from passing. The barrier comprises a body and a structure.

The body has a surface. The structure is a microstructure or a nanostructure. The structure is formed on at least a first part of the surface. The first part is thus configured to hinder the foreign matter from adhering thereto. The structure and the body are monolithic.

This allows for solving the above problems. In particular, this allows for hindering debris from entering the delicate electronic components (elements) of the hearing device by allowing for ensuring that the surface functions as a hydrophobic surface, which is more hydrophobic than a surface without the structure. This further allows for improving robustness of the hearing device.

A barrier refers to an obstacle for the foreign matter on its way through the ear canal. Foreign matter refers to debris, i.e., to earwax (cerumen), water or moist, sweat (sudor) or any kind of dirt in the ear canal. Adhering refers to sticking without being glued or using any other adhesive. Monolithic refers to being integrally formed without being manufactured separately and then being assembled together or without being manufactured in two distinct steps. In other words, monolithic refers to a homogeneous microstructure which does not exhibit any structural components distinguishable by (optical) microscopy. That is to say, if the structure and the body were examined by means of microscopy, no transition or boundary was recognizable. Nanostructure refers to a structure comprising particles or elements having an intermediate size between 0.1 and 100 nm. Microstructure refers to a structure comprising particles or elements having an intermediate size between 0.1 and 100 μm.

According to another aspect, a method for manufacturing a hearing device is provided. The hearing device is suitable for being at least partially inserted into an ear canal. The method comprises the steps of forming a texture and molding a barrier. The texture, which is a microstructure or a nanostructure, is formed on at least a first portion of a surface of a mold cavity of a mold. The barrier of the hearing device, which barrier comprises a body having a surface, is molded by use of the mold. The barrier is configured to prevent foreign matter inside the ear canal from passing. The texture impresses a structure, which is a microstructure or a nanostructure, on a first part of the surface of the barrier during the molding. Due to the structure the first part is configured to hinder the foreign matter from adhering to the first part. The structure and the body are monolithic. The structured part of the surface thus exhibits a first hydrophobicity and the part of the barrier which do not have the structured or textured surface exhibit a second, lower, hydrophobicity. This difference in hydrophobicity is contemplated to provide the enhanced protection of the hearing aid device by improved removal efficiency of debris and moisture from the (sound) outlet of the barrier. This means that the area where the structure is formed is more hydrophobic than the area where the structure is not formed.

Generally, the present disclosure relates to a barrier element suitable to be arranged with a hearing device, i.e. a hearing aid. The hearing aid may have a housing that is configured to be positioned at least partly in the ear canal of a user. The barrier is configured to be releasably attached to the housing, e.g. via a snap connection or other type of releasable connection. The barrier, or barrier element, may comprise a body with a surface, where a first surface part, i.e. a first part of the surface, of that body may have a structure defined on that surface. The structure is preferably formed as part of a molding process or e.g. by a laser that removes or relocates parts of the surface, i.e. not as a layer deposited thereon after molding or production. The barrier has thus at least two areas on the surface, where one area has a higher hydrophobicity that the other, this means that liquids will be less likely to adhere to the higher hydrophobicity area than the lower hydrophobicity area, thereby wicking liquids away from the high hydrophobicity area.

This allows for making a barrier (e.g., a dome or filter), where the structures are formed (e.g., laser printed) into a mold, from which the barriers (filters, domes or other relevant hearing device parts) can be molded, thus integrating the micro- and nanostructures in the final element (barrier) coming out of the mold. The thus formed hearing device allows for the same effects as previously described. Summed up, the texture is added to the molding tool and replicated to the barriers during the molding process.

The barrier may include one or more sound openings to allow sound to pass from an output transducer through the barrier and towards the ear drum. Additional opening or openings may also be provided, e.g. for pressure relief, ventilation or the like as is also described herein.

Impressing refers to the mold including the texture being pressed against the material, from which the body and the structure of the barrier are to be made. Impressing also refers to the material being pressed against the mold including the texture. Further, impressing refers to the mold and the material being mutually pressed on each other.

Preferably, a hearing device according to any of the aspects presented herein is provided, wherein the barrier is constituted by a dome, by a filter of a transducer or by holes and sharp edges of the hearing device being configured to allow soundwaves to pass.

This allows for effectively preventing debris from impairing sensitive electronic components of the hearing device, particularly the transducers (i.e., the microphone(s) and the receiver(s)). Making small geometries, such as holes and sharp edge provides for enough repelling force for the debris to not to be able to enter, acting as a barrier for debris but not for soundwaves. This allows for eliminating the need for physical (distinctly provided) barriers and nets, which can fill up and clog over time. This further allows for using the micro- and nanostructure (partly) at the surface of a filter.

Preferably, a hearing device according to any of the aspects presented herein is provided, wherein the barrier is constituted by a dome and the first part is at least partially constituted by a membrane and/or a guiding structure of the dome.

This allows for effectively preventing debris from being aggregated/accumulated on parts of the dome, which are particularly sensitive or susceptible to debris aggregation/accumulation. By constructing the micro- or nanostructure on or near areas that a sensitive to debris aggregation/accumulation, the debris is less likely to stay on or even move to these areas.

The working principle of domes with membranes is that when the sound from the speaker hits one side of the membrane, the membrane moves, acting like a speaker on the other side. Domes with membranes are thus especially sensitive to debris. Even thin layers of debris will change the weight and hinder the movement of the membrane, thus affecting the acoustic performance. The nanostructure can be (locally) applied to either the membrane (center), near (for example, around) the membrane or to the complete surface of the membrane or the dome.

In all domes, i.e., such with or without a membrane, the structure can be applied to the front of the dome towards the eardrum. The structure will help to guide the debris towards the periphery of the dome and thus prevent clogging of the dome.

Guiding structures of the dome can be provided inside the dome, to pass the debris through the dome towards the ear canal opening, or to the outside of the dome, to guide the debris towards the periphery of the dome. Both allows for effectively protecting sensitive components of the hearing devices.

Preferably, a hearing device according to any of the aspects presented herein is provided, wherein the first part is at least partially constituted by a sound canal of a transducer.

This allows for effectively protecting the transducer from being clogged with debris.

Preferably, a hearing device according to any of the aspects presented herein is provided, wherein the barrier has openings being small enough to prevent the foreign matter from passing but being large enough to allow soundwaves or air for pressure equalization and/or ventilation to pass.

This allows for the barrier to effectively prevent passage of debris to sensitive components of the hearing device and to maintain operability of the hearing device. It allows for the barrier to be used as a filter. This further allows for equalizing the pressure between the space, which has to be ensured between the hearing device and the ear drum (tympanic membrane) to protect the ear drum from injuries by the hearing device, and the part of the ear canal between the hearing device and the ear canal opening. Thus, it allows for avoiding uncomfortable feeling of the hearing device user due to a pressure difference. This further allows for ventilating the space between the hearing device and the ear drum, since moisture is likely to collect/accumulate in the space.

Preferably, a hearing device according to any of the aspects presented herein is provided, wherein the openings are arranged in the first part or are surrounded by the first part without being arranged in the first part.

This allows for effectively keeping the debris away from the openings or for guiding/conveying the debris from the openings.

Preferably, a hearing device according to any of the aspects presented herein is provided, wherein the surface has a second part, which is configured to promote the foreign matter in adhering thereto.

This allows for even more efficiently keeping the debris away from the openings or for guiding/conveying the debris from the openings. The main driver for moving the debris is still gravity. But in cases where debris is placed across an edge between a micro- or nanostructured surface and a normal surface (i.e., a surface without a micro- or nanostructure), the debris will be drawn to be fully on the normal surface, thus moving from the micro- or nanostructure to the normal surface due to surface conditions. Due to the surface conditions the debris forms heavier droplets with a smaller underground-surface interface. The droplets are more likely to move on the surface on the hydrophobic areas. If debris is applied evenly over the entire surface with localized hydrophobic structures, the debris will position it in a thicker layer in the normal surface areas.

Preferably, a hearing device according to any of the aspects presented herein is provided, wherein the second part is arranged to surround the first part.

This allows for even better keeping the debris away from the sensitive parts of the hearing device. It further allows for even better guiding/conveying the debris from the sensitive parts.

Preferably, a hearing device according to any of the aspects presented herein is provided, wherein the structure is a nanostructure having a thickness in the range of 0.1 to 100 nm.

This allows for making the first surface (or any other surface, to which the nanostructure is applied) hydrophobic. In fact, nanostructures can make surfaces even superhydrophobic, superhydrophilic or even self-cleaning to minimize debris ingress.

Preferably, a hearing device according to any of the aspects presented herein is provided, wherein the surface has in the first part a contact angle being more than 12° larger than a contact angle of a surface with the same surface material not having the structure.

This allows for providing a particularly (super)hydrophobic surface.

Preferably, a hearing device according to any of the aspects presented herein is provided, wherein the first part is superhydrophobic and the surface has in the first part a contact angle of 150° or more.

A (super)hydrophobic surface repels water. An example of a hydrophobic surface is shown in FIG. 1. When a liquid droplet interacts with a surface the interaction can be described with terms such as wetting, spreading, adhesion and de-wetting. Wettability describes the interaction, when a liquid first meets a solid surface. Wettability is a degree of wetting that is determined by a force balance of adhesive and cohesive forces, where adhesive forces are the forces between the molecules in the droplet and the surface and the cohesive forces are between molecules in each material separately. The term wetting refers to the study of how a droplet is spread out, or not spread out, on a surface and its ability to maintain contact with the surface.

One definition of wettability expresses that wetting of a surface by a liquid can be described by the shape of the droplet and the droplets contact angle CA, as shown in FIG. 2. In the figure, the CA is presented as $\theta_0$. The CA is also called Young's angle or the static CA and is derived from the tangential angle at the solid-liquid-air interface. The location, where these three substances (the solid, the liquid and the air) meet is also called the contact line. How the surface is wetted by the liquid is also directly related to the surface energy, where surfaces with low energy will show large CAs. Surface energy is caused by the disruption of intermolecular bonds that occur when a surface is created. The three surface energies $\gamma$ are presented in FIG. 2. These are related to the surface (S), gas (G) and liquid (L). Together, these three surface energies $\gamma$ form the shape of the droplet. In the figure, $\gamma_{SG}$ is the projected surface tension at the interference between solid-gas, $\gamma_{SL}$ is between solid-liquid and $\gamma_{LG}$ is between liquid-gas. $\theta_0$ is the CA when the droplet is at rest and the surface tensions have reached equilibrium.

The CA is used to determine if a surface is hydrophobic or hydrophilic, where a hydrophobic surface has a CA larger than 90° and a hydrophilic surface an CA below 90° (as in FIG. 2). In addition, a superhydrophobic surface can be roughly defined as a surface having a CA larger than 150°.

The superhydrophobic properties are often created on a surface with a proper two-level topography with micro- and nano-sized structures. The roughness of the surface enhances both the hydrophobic and hydrophilic properties. If a surface is hydrophobic, an increased roughness will make the surface even more hydrophobic. In the same way a hydrophilic surface will become even more hydrophilic if the roughness is increased.

Preferably, a hearing device and/or a method according to any of the aspects presented herein is provided, wherein the barrier is formed of a polymer based on polypropylene or polyamide, preferably on amorphous polyamide with or without glass fibers and most preferably on semi-crystalline polyamide with glass fibers.

This allows for effectively creating superhydrophobic surfaces as a combination of a nanostructure and a specific material. The specific material includes a polymer based on polypropylene or polyamide. The polymer is preferably based on amorphous polyamide with or without glass fibers. The polymer is most preferably based on semi-crystalline polyamide with glass fibers. This allows for generating most superhydrophobic surfaces.

Preferably, a method according to any of the aspects presented herein is provided, wherein the texture is formed by laser etching, and/or the molding is injection molding or compression molding.

This provides for efficiently providing the micro- or nanostructure. It provides for reducing costs and time required for manufacturing the hearing device.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effects will be apparent from and elucidated with reference to the illustrations described hereinafter in which:

DETAILED DESCRIPTION

Figure 1:
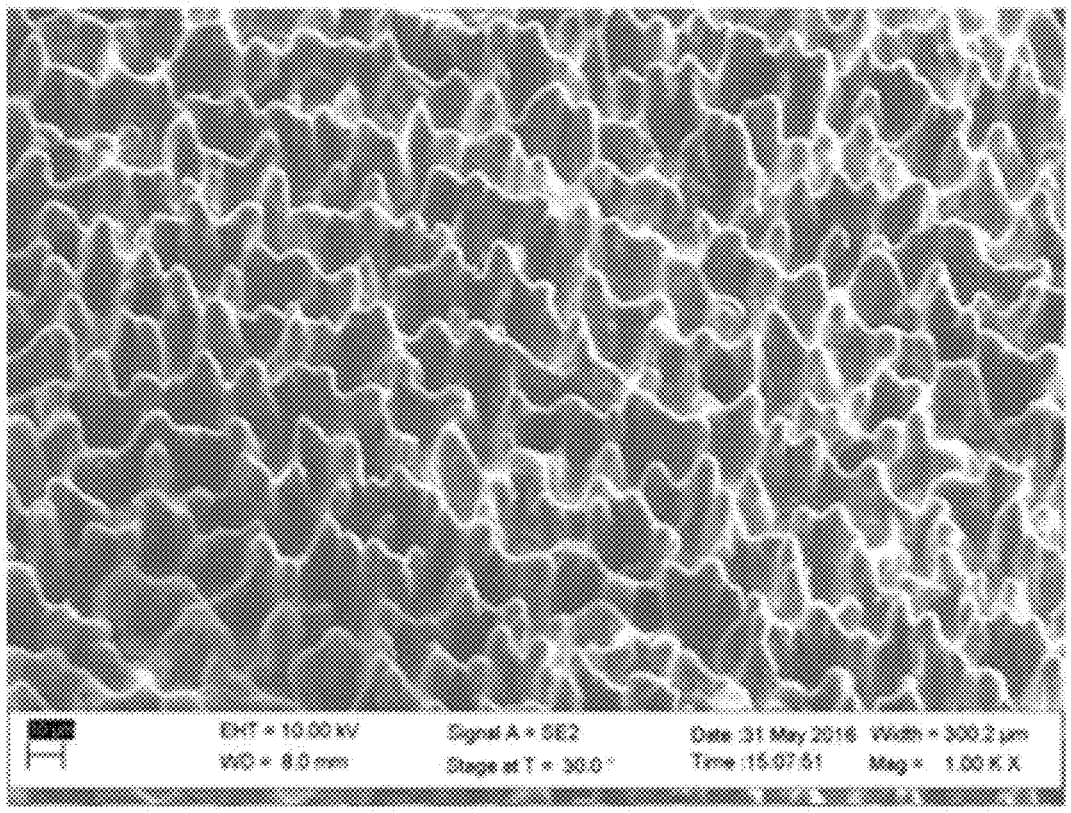
FIG. 1 illustrates an example of the structure of a hydrophobic surface according to an embodiment of the disclosure.

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details. Several aspects of the apparatus and methods are described by various functional units, modules, components, processes, etc. (collectively referred to as "elements").

A hearing device may include a hearing aid that is adapted to improve or augment the hearing capability of a user by receiving an acoustic signal from a user's surroundings, generating a corresponding audio signal, possibly modifying the audio signal and providing the possibly modified audio signal as an audible signal to at least one of the user's ears. The "hearing device" may further refer to a device such as an earphone or a headset adapted to receive an audio signal electronically, possibly modifying the audio signal and providing the possibly modified audio signals as an audible signal to at least one of the user's ears. Such audible signals may be provided in the form of an acoustic signal radiated into the user's outer ear, or an acoustic signal transferred as mechanical vibrations to the user's inner ears through bone structure of the user's head and/or through parts of middle ear of the user or electric signals transferred directly or indirectly to cochlear nerve and/or to auditory cortex of the user.

The hearing device is adapted to be worn in any known way. This may include i) arranging a unit of the hearing device behind the ear with a tube leading air-borne acoustic signals into the ear canal or with a receiver/loudspeaker arranged close to or in the ear canal such as in a Behind-the-Ear type hearing aid, and/or ii) arranging the hearing device entirely or partly in the pinna and/or in the ear canal of the user such as in a In-the-Ear type hearing aid or In-the-Canal/Completely-in-Canal type hearing aid, or iii) arranging a unit of the hearing device attached to a fixture implanted into the skull bone such as in Bone Anchored Hearing Aid or Cochlear Implant, or iv) arranging a unit of the hearing device as an entirely or partly implanted unit such as in Bone Anchored Hearing Aid or Cochlear Implant.

In general, a hearing device includes i) an input unit such as a microphone for receiving an acoustic signal from a user's surroundings and providing a corresponding input audio signal, and/or ii) a receiving unit for electronically receiving an input audio signal. The hearing device further includes a signal processing unit for processing the input audio signal and an output unit for providing an audible signal to the user in dependence on the processed audio signal.

The input unit may include multiple input microphones, e.g. for providing direction-dependent audio signal processing. Such directional microphone system is adapted to enhance a target acoustic source among a multitude of acoustic sources in the user's environment. In one aspect, the directional system is adapted to detect (such as adaptively detect) from which direction a particular part of the microphone signal originates. This may be achieved by using conventionally known methods. The signal processing unit may include amplifier that is adapted to apply a frequency dependent gain to the input audio signal. The signal processing unit may further be adapted to provide other relevant functionality such as compression, noise reduction, etc. The output unit may include an output transducer such as a loudspeaker/receiver for providing an air-borne acoustic signal transcutaneously or percutaneously to the skull bone or a vibrator for providing a structure-borne or liquid-borne acoustic signal. In some hearing devices, the output unit may include one or more output electrodes for providing the electric signals such as in a Cochlear Implant.

In the present disclosure, instead of using the chemical coating (or in addition thereto), a structure (imprinted from a textured mold) of the surfaces of e.g. domes and filters (or potentially also the shell parts) of the hearing device are made. However, especially with regards to surfaces which are in contact with a user's fingers (such as e.g. the shells), also a chemical hydrophobic coating is needed. This is due to the fact, that if the user touches the laser structured surface, the dirt, sweat etc. from the skin of a user will potentially damage or impair the structure. Thus for especially the hearing aid shells, a double feature in the form of both structure (1st) and chemical hydrophobic coating (2nd) is used to get a superhydrophobic surface. Again, the chemical nanocoating is not used for the dome surfaces or filters due to potential clogging of the holes in the domes or filters.

In view of especially the domes, it is relevant that the silicone material, which domes are normally made form in itself has a hydrophobic surface. Thus, by applying the imprinted structure to the already hydrophobic material of the dome material, a superhydrophobic surface of the domes (and similarly the filters) is achieved.

Incidentally, the structure on the finished surface of e.g. the dome, filter, shell etc. is dependent on the properties of the material which is to be molded into a specific shape. That is, the more floating property of the material, the more likely the material is to seek into any small holes (texture) in the mold, so as to create a very fine structure imprinted by the texture of the mold. Thus a material which has less floating capability (which is more viscous) is more prone to create a less structured surface. This influences the (super)hydrophobic properties of the surface of the barrier.

The fine structure according to the disclosure is especially relevant for domes, since the silicone material is introduced to the mold in a floating manner, whereby the silicone is able to seek into all grooves, gaps, etc. (texture) of the mold, and thereby create a fine structured surface of the texture in the mold onto the dome as a structure.

With regard to the filters, the same principles apply accordingly. A chemical hydrophobic nanocoating is not applied due to the risk of clogging the filter holes. Accordingly, the imprinted structure is used instead to make the surface (super)hydrophobic without any chemical coating.

Now referring to FIG. 1, which illustrates a shape of a (super)hydrophobic structure of a surface according to an aspect of the disclosure. The figure shows an exemplary zoom of an imprinted surface. In case of a nanostructure, the ridges and the bottoms of the irregular structure have a mean distance of 0.1 to 100 nm. In case of a microstructure, the distance is 0.1 to 100 μm. The depicted structure of the surface of a dome, filter etc. is formed with the body of the dome, filter etc. integrally (in one piece), without any (recognizable) transition or border.

On the other hand, micro- and nanostructures, which are applied to body surfaces by chemical coatings have a different consistency (e.g., grain structure and size/shape). There is a more or less sharp separating line between the body and the structured surface in a sectional view of the chemically coated element, e.g., a shell.

Figure 2:
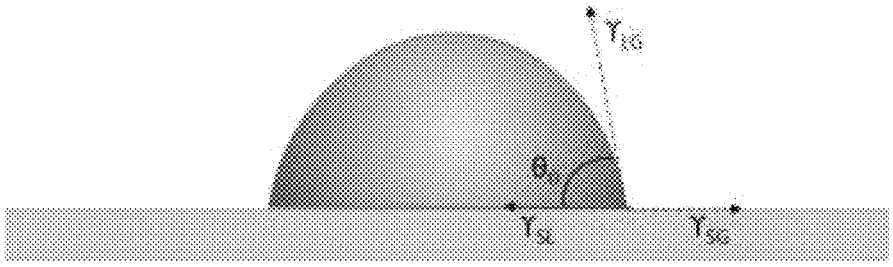
FIG. 2 illustrates a droplet on a surface.

FIG. 2 shows a contact angle $\theta_0$, being less than 90°. Accordingly, the depicted surface is non-hydrophobic, i.e., is hydrophilic. The figure only serves for illustrating the principle of wetting of a surface by a droplet.

Figure 3:
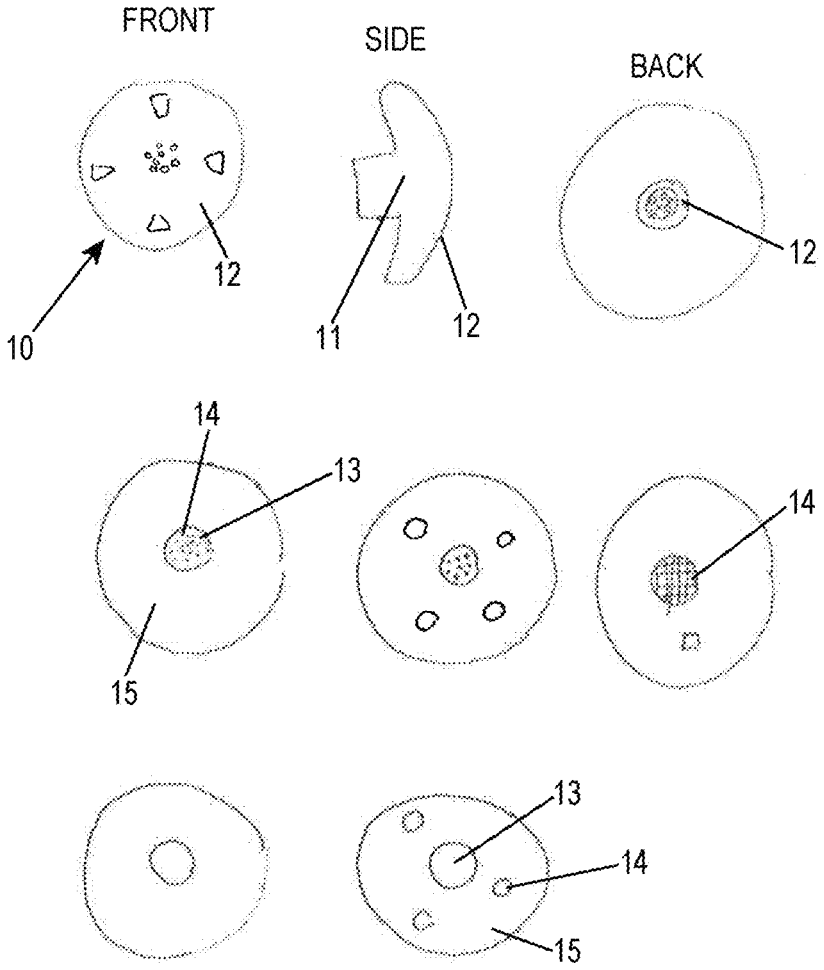
FIG. 3 illustrates domes according to embodiments of the disclosure.

FIG. 3 shows a dome 10 as one example of a barrier according to one aspect of the disclosure. In the upper row, a front, side and back view of the dome 10 is presented. In the middle and lower row, different types of domes 10 are depicted in the front view. The middle row shows domes 20 having integrally provided filter elements, while the lower row shows domes 20 having an integrally provided membrane. All the depicted examples can be combined.

The dome 10 has a body 11 and a surface 12. The surface 12 can be a surface, which is arranged on the outside of the dome 10, i.e., which is directly disposed to the ear canal 1 (which faces the ear canal walls, the ear canal opening and the ear drum). The surface 12 can also be a surface, which is arranged on the inside of the dome 10, e.g., in a through or blind hole of the dome 10.

The dome 10 has openings 14. The openings 14 can be provided for sound transmission. Examples of this kind of openings (sound canals) are denoted with reference numeral 14 in the middle row of FIG. 3. The openings 14 can be provided for pressure equalization and/or ventilation. An example of this kind of opening 14 is denoted with reference numeral 14 in the lower row of FIG. 3. The left domes 10 in the middle and lower row do not have the ventilation/ pressure equalization feature. All depicted openings 14 are small enough to not allow debris to pass through.

In FIG. 3, reference number 13 denotes the first part of the surface 12, i.e., the part, to which the micro- or nanostructure according to the disclosure is imprinted during molding by the texture of the mold.

The first part 13 is (super)hydrophobic by the structure and further by the choice of the material of the dome 10.

In the middle row of FIG. 3, the first part 13 corresponds to a filter, which is integrally provided in the dome 10. In the lower row of FIG. 3, the first part 13 corresponds to a membrane of the dome 10.

Reference number 15 in FIG. 3 depicts the second part of the surface 12 according to the disclosure. The second part 15 is non-(super)hydrophobic. Preferably, the second part 15 is hydrophilic, so as to guide debris away from the first part 13.

Figure 4:
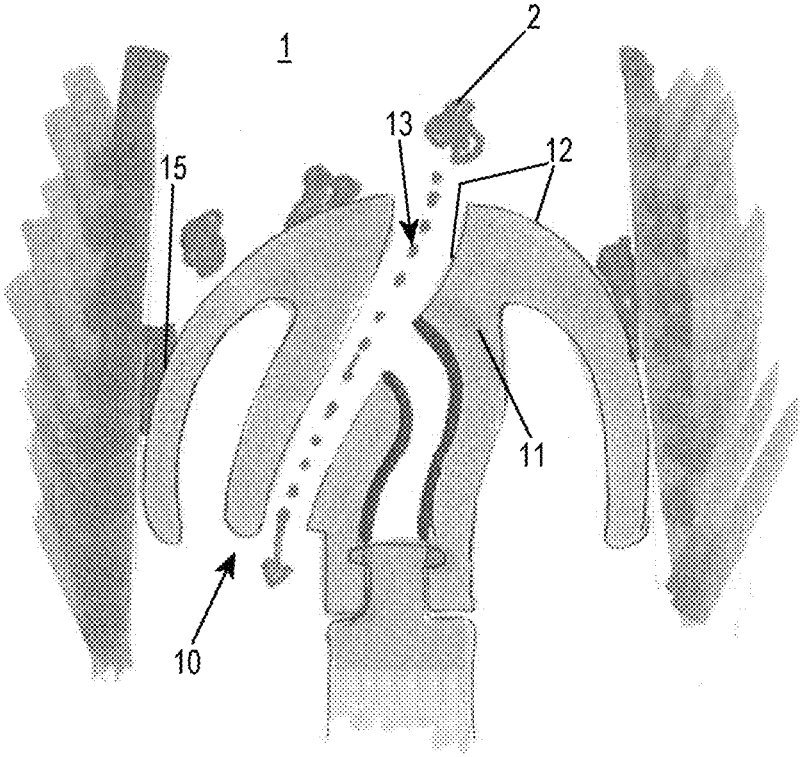
FIG. 4 illustrates a dome according to an embodiment of the disclosure.

FIG. 4 shows a dome 10 in a sectional view being inserted into an ear canal 1. The transducer (receiver) of the hearing aid is shown in a side view.

The dome 10 shown in FIG. 4 has a body 11 having a (general) surface 12, which has a first part 13 and a second part 15. The first part 13 is exemplarily constituted by the branch of the through hole (canal) of the dome 10, which directly leads to the transducer. In FIG. 4, the first part 13 is represented by a thick line of (a part of) the canal of the dome 10. The second part 15 is exemplarily constituted by the outer portion of the front (upper in the figure) surface 12 of the dome 15. Thus, debris (ear wax in the FIG. 2 is guided to the outer periphery of the dome 10 and away from the (main) canal of the dome 10.

Although not depicted in FIG. 4, the entire (main) canal (through hole) of the dome 10 can be provided with the structure according to the disclosure, i.e., can correspond to the first part 13 of the surface 12. Thus, the ear wax 2, which is not led to the outer periphery of the dome 10 can be efficiently guided thorough the dome 10 and towards the opening of the ear canal 1. This movement of the ear wax 2 through the dome 10 is represented by the broken line in FIG. 4.

By utilizing combinations of hydrophobic and hydrophilic surfaces it possible to create labyrinths, pockets, traps and barriers to guide the ear wax 2.

Figure 5:
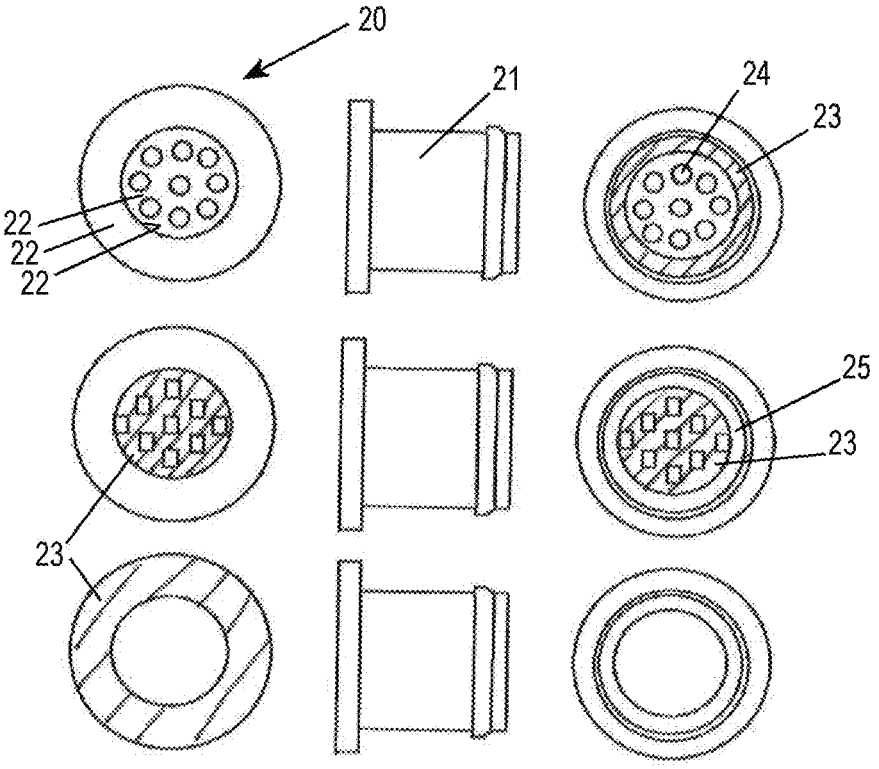
FIG. 5 illustrates filters according to an embodiment of the disclosure.

FIG. 5 shows exemplary embodiments of a filter 20 according to the present disclosure. In FIG. 5, the left column shows a front view of the filter 20, the middle column shows a side view of the filter 20 and the right column shows a back view of the filter 20. All the depicted examples can be combined.

The filter 20 has a body 21 and a surface 22. The surface 22 can be a surface, which is arranged on the outside of the filter 20, i.e., which is directly disposed to the ear canal 1 (which faces the ear canal walls, the ear canal opening and the ear drum). The surface 22 can also be a surface, which is arranged on the inside of the filter 20, e.g., in a through or blind hole of the filter 20.

The filter 20 has openings 24. The openings 24 are provided for sound transmission. All depicted openings 24 are small enough to not allow debris to pass through. The openings 24 can have any desired shape.

In FIG. 5, reference number 23 denotes the first part of the surface 22, i.e., the part, to which the micro- or nanostructure according to the disclosure is imprinted during molding by the texture of the mold.

The first part 23 is (super)hydrophobic by the structure and further by the choice of the material of the filter 20.

In the upper row of FIG. 5, the first part 23 exemplarily corresponds to the inner periphery of the (main) through hole of the filter 20. Thus, even if foreign matter unexpectedly enters the filter 20, it is guided to the outside thereof.

In the middle row of FIG. 5, the first part 23 exemplarily corresponds to a the faceplate of the filter 20, in which the sound transmission openings 24 are provided.

Reference number 25 in FIG. 5 depicts the second part of the surface 22 according to the disclosure. The second part 25 is non-(super)hydrophobic. Preferably, the second part 25 is hydrophilic, so as to guide debris away from the first part 23. The second part 25 surrounds the first part 23 so as to guide debris to the outside periphery of the filter 20.

In the lower row of FIG. 5, the first part 23 exemplarily corresponds the outer periphery of the (central) through hole or of the membrane of the filter 20. Preferably, the first part 23 is constituted by the front surface of the front flange of the filter 20. In the depicted embodiment, the faceplate including the openings 24 has been left out and replaced by a membrane. The first part 23 arranged around the membrane is sufficient to guide debris to the outer periphery of the filter 20 and thus away from the membrane.

The micro- or nanostructures are used locally in the filters 20 to protect the membrane or sound canals against foreign matter.

Generally, the present disclosure relates to:

1 A hearing device suitable for being at least partially inserted into an ear canal (1), comprising a barrier (10, 20) configured to prevent foreign matter (2) inside the ear canal (1) from passing, the barrier (10, 20) comprising a body (11, 21) having a surface (12, 22), and a structure, which is a microstructure or a nanostructure, wherein the structure is formed on at least a first part (13, 23) of the surface (12, 22), and the first part (13, 23) is thus configured to hinder the foreign matter (2) from adhering thereto, and the structure and the body (11, 21) are monolithic.

2. Hearing device according to item 1, wherein the barrier (10, 20) is constituted by a dome, by a filter of a transducer or by holes and sharp edges of the hearing device being configured to allow soundwaves to pass.

3. Hearing device according to item 1, wherein the barrier (10) is constituted by a dome and the first part (13) is at least partially constituted by a membrane and/or a guiding structure of the dome.

4. Hearing device according to any of the preceding items, wherein the first part (13, 23) is at least partially constituted by a sound canal of a transducer.

5. Hearing device according to any of the preceding items, wherein the barrier (10, 20) has openings (14, 24) being small enough to prevent the foreign matter (2) from passing but being large enough to allow soundwaves or air for pressure equalization and/or ventilation to pass.

6. Hearing device according to item 5, wherein the openings (14, 24) are arranged in the first part (13, 23) or are surrounded by the first part (13, 23) without being arranged in the first part (13, 23).

7. Hearing device according to any of the preceding items, wherein the surface (12, 22) has a second part (15, 25), which is configured to promote the foreign matter (2) in adhering thereto.

8. Hearing device according to item 7, wherein
the second part (15, 25) is arranged to surround the first part (13, 23).

9. Hearing device according to any of the preceding items, wherein
the structure is a nanostructure having a thickness in the range of 0.1 to 100 nm.

10. Hearing device according to any of the preceding items, wherein
the surface (12, 22) has in the first part (13, 23) a contact angle being more than 12° larger than a contact angle of a surface with the same surface material not having the structure.

11. Hearing device according to any of the preceding items, wherein
the first part (13, 23) is superhydrophobic and the surface (12, 22) has in the first part (13, 23) a contact angle of 150° or more.

12. Hearing device according to any of the preceding items, wherein
the barrier (10, 20) is formed of a polymer based on polypropylene or polyamide, preferably on amorphous polyamide with or without glass fibers and most preferably on semi-crystalline polyamide with glass fibers.

13. Method for manufacturing a hearing device, which is suitable for being at least partially inserted into an ear canal (1), comprising the steps of
forming a texture, which is a microstructure or a nanostructure, on at least a first portion of a surface of a mold cavity of a mold, and
molding a barrier (10, 20) of a hearing device comprising a body (11, 21) having a surface (12, 23) by use of the mold, the barrier (10, 20) being configured to prevent foreign matter (2) inside the ear canal (1) from passing, wherein
the texture impresses a structure, which is a microstructure or a nanostructure, on a first part (13, 23) of the surface (12, 22) during the molding so that
the first part (13, 23) is thus configured to hinder the foreign matter (2) from adhering thereto, and
the structure and the body (11, 21) are monolithic.

14. Method according to item 13, wherein
the texture is formed by laser etching, and/or
the molding is injection molding or compression molding.

15. Method according to item 13 or 14, wherein
the barrier (10, 20) is formed of a polymer based on polypropylene or polyamide, preferably on amorphous polyamide with or without glass fibers and most preferably on semi-crystalline polyamide with glass fibers It is intended that the structural features of the devices described above, either in the detailed description and/or in the claims, may be combined with steps of the method, when appropriately substituted by a corresponding process.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening elements may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

The invention claimed is:

1. Hearing device having a housing suitable for being at least partially inserted into an ear canal, comprising:
a barrier configured to be releasably connectable to the housing and the barrier being configured to prevent foreign matter inside the ear canal from passing, the barrier being constituted by a dome, the barrier comprising:
a body having a surface, and
a first part of the body having formed thereon a structure, which is a microstructure or a nanostructure, wherein
the part of the body outside the first part having a first hydrophobicity and the first part having a second, higher, hydrophobicity, and
the first part is a filter thus configured to hinder the foreign matter from adhering thereto, the filter being integral with the dome, and
the structure and the body are monolithic.

2. Hearing device according to claim 1, wherein the first part is at least partially constituted by a membrane and/or a guiding structure of the dome.

3. Hearing device according to claim 1, wherein the barrier has openings being small enough to prevent the foreign matter from passing but being large enough to allow soundwaves or air for pressure equalization and/or ventilation to pass.

4. Hearing device having a housing suitable for being at least partially inserted into an ear canal, comprising:
a barrier configured to be releasably connectable to the housing and the barrier being configured to prevent foreign matter inside the ear canal from passing, the barrier being constituted by a filter of a transducer or by holes and sharp edges of the hearing device being configured to allow soundwaves to pass, the barrier comprising:

a body having a surface, and a first part of the body having formed thereon a structure, which is a microstructure or a nanostructure, wherein the part of the body outside the first part having a first hydrophobicity and the first part having a second, higher, hydrophobicity, the first part is thus configured to hinder the foreign matter from adhering thereto, the structure and the body are monolithic, and the barrier is integral with a dome.

5. Hearing device according to claim 4, wherein the surface has a second part, which is configured to promote the foreign matter in adhering thereto.

6. Hearing device according to claim 5, wherein the first part is at least partially constituted by a sound canal of a transducer.

7. Hearing device according to claim 5, wherein the barrier has openings being small enough to prevent the foreign matter from passing but being large enough to allow soundwaves or air for pressure equalization and/or ventilation to pass.

8. Hearing device according to claim 7, wherein the openings are arranged in the first part or are surrounded by the first part without being arranged in the first part.

9. Hearing device according to claim 5, wherein the surface has a second part, which is configured to promote the foreign matter in adhering thereto.

10. Hearing device according to claim 5, wherein the second part is arranged to surround the first part.

11. Hearing device according to claim 5, wherein the structure is a nanostructure having a thickness in the range of 0.1 to 100 nm.

12. Hearing device according to claim 5, wherein the surface has in the first part a contact angle being more than 12° larger than a contact angle of a surface with the same surface material not having the structure.

13. Hearing device according to claim 5, wherein the first part is superhydrophobic and the surface has in the first part a contact angle of 150° or more.

14. Hearing device according to claim 5, wherein the barrier is formed of a polymer based on polypropylene or polyamide.

15. Hearing device according to claim 1, wherein the structure is a nanostructure having a thickness in the range of 0.1 to 100 nm.

16. Hearing device according to claim 1, wherein the surface has in the first part a contact angle being more than 12° larger than a contact angle of a surface with the same surface material not having the structure.

17. Hearing device according to claim 1, wherein the first part is superhydrophobic and the surface has in the first part a contact angle of 150° or more.

18. Hearing device according to claim 1, wherein the barrier is formed of a silicone material.

19. Method for manufacturing a hearing device, which is suitable for being at least partially inserted into an ear canal, comprising the steps of forming a texture, which is a microstructure or a nanostructure, on at least a first portion of a surface of a mold cavity of a mold, and molding a barrier, constituted by a dome, of a hearing device comprising a body having a surface by use of the mold, the barrier being configured to prevent foreign matter inside the ear canal from passing, wherein the texture impresses a structure, which is a microstructure or a nanostructure, on a first part of the surface during the molding so that the first part is a filter thus configured to hinder the foreign matter from adhering thereto, the filter being integral with the dome, and the structure and the body are monolithic.

20. Method according to claim 19, comprising:

forming the texture by laser etching, and/or molding being performed by injection molding or compression molding.

21. Hearing device according to claim 5, wherein the barrier is formed of a polymer based on amorphous polyamide with or without glass fibers.

22. Hearing device according to claim 4, wherein the barrier is formed of a polymer based on semi-crystalline polyamide with glass fibers.

* * * * *